US009149910B2

(12) United States Patent
Lu et al.

(10) Patent No.: US 9,149,910 B2
(45) Date of Patent: Oct. 6, 2015

(54) GRINDING WORKBENCH WITH IMPROVED STRUCTURE

(71) Applicants: Li-Chou Lu, New Taipei (TW); Ming-En Lu, New Taipei (TW)

(72) Inventors: Li-Chou Lu, New Taipei (TW); Ming-En Lu, New Taipei (TW)

( * ) Notice: Subject to any disclaimer, the term of this patent is extended or adjusted under 35 U.S.C. 154(b) by 0 days.

(21) Appl. No.: 14/190,573

(22) Filed: Feb. 26, 2014

(65) Prior Publication Data

US 2015/0038060 A1 Feb. 5, 2015

(30) Foreign Application Priority Data

Jul. 31, 2013 (TW) ..... 102214339 U

(51) Int. Cl.
*B24C 3/06* (2006.01)
*B24B 27/00* (2006.01)
*B24B 55/06* (2006.01)

(52) U.S. Cl.
CPC ..... *B24C 3/065* (2013.01); *B24B 27/0007* (2013.01); *B24B 55/06* (2013.01)

(58) Field of Classification Search
CPC .... B24B 27/0076; B24B 55/05; B24B 55/06; B24C 3/06; B24C 3/065; B24C 5/04; B24C 7/0046
See application file for complete search history.

(56) References Cited

U.S. PATENT DOCUMENTS 3,352,063 A * 11/1967 Eppler ..... 451/89
3,599,375 A * 8/1971 Nunemaker ..... 451/89
4,300,318 A * 11/1981 Brown ..... 451/88
4,923,251 A * 5/1990 Funakawa et al. ..... 299/64
6,099,395 A * 8/2000 Guseman ..... 451/75

* cited by examiner

*Primary Examiner* — Timothy V Eley
(74) *Attorney, Agent, or Firm* — Muncy, Geissler, Olds & Lowe, P.C.

(57) ABSTRACT

The present invention is primarily assembled from a main body, a lifting device, a control switch, a grinding device, a nozzle apparatus, and a dust collecting device. The main body includes a first casing, and a second casing disposed within the first casing. The lifting device enables raising and lowering of the first casing relative to the second casing for adjustment to a suitable height. An operating area at the top of the first casing is equipped with the control switch. The nozzle apparatus includes an air compressor, a dryer, a sand storage tank, and a nozzle, which facilitate the user in operational use, and enable powerful collection of dust. In particular, during the sand blasting process, the present invention enables optimum handling of environmental dust pollution.

8 Claims, 6 Drawing Sheets

GRINDING WORKBENCH WITH IMPROVED STRUCTURE

BACKGROUND OF THE INVENTION (a) Field of the Invention

The present invention creation relates to a grinding workbench, and more particularly to a grinding workbench with improved structure that provides the user with a design that conforms to ergonomics, is easy to use, and enables powerful collection of dust. Moreover, the grinding workbench with improved structure is able to remove burrs from extruded objects, remove surface dirt and finish the surface of objects using a sand blasting method.

(b) Description of the Prior Art

The majority of grinding workbenches or grinding machines of the prior art have a fixed structure and height, and mainly have an open structure. Therefore, it is necessary to accommodate the height of the grinding workbench or grinding machine when operating such machines.

However, because the operation mode and angle of such grinding workbenches or grinding machines are usually fixed by the structural configuration, thus, when the height of the grinding workbench or grinding machine is not appropriate to the stature of the operator, and because of the inability to adjust the height of the machine, it causes inconvenience to the operator when operating such machines, to the extent of resulting in injury to the machine operator.

In addition, because the dust produced during the grinding process is inhaled into the body, this further results in injury to the health of the machine operator. Moreover, when the machine operator is finishing the surface of an object, a cutting tool or other tool must be used to manually remove the burrs of the object, remove surface dirt, and retouch the surface of the object. However, because of misoperation by the machine operator, such a method directly leads to very easily damaging the surface of the object.

Hence it can be seen that are still a great many shortcomings in the grinding workbenches or grinding machines of the prior art which are in need of urgent improvement.

SUMMARY OF THE INVENTION

A primary objective of the present invention lies in providing a grinding workbench with improved structure that provides the user with a design that conforms to ergonomics, is easy to use, and enables powerful collection of dust. Moreover, the grinding workbench with improved structure is able to remove burrs from extruded objects, remove surface dirt and finish the surface of objects using a sandblasting method.

In order to achieve the aforementioned objective, the grinding workbench with improved structure of the present invention comprises: a main body, which consists of a first casing, and a second casing disposed within the first casing, the second casing is equipped with a lifting device, which is assembled from a lifting platform disposed in the second casing, and a lifting rod joined to the lifting platform and connected to the first casing, thereby enabling a raising and lowering movement of the first casing; an operating area configured on the top of the first casing, a dust collecting opening is defined in the operating area, and a transparent component is disposed on the top surface of the operating area, a light emitting component is disposed on the inner side of the top surface of the operating area, and an operating opening is formed in each of two side walls of the operating area, with the operating openings providing passage to the interior of the operating area, in addition, a control switch is located inside the operating area, a grinding device is electrically connected to the control switch, and a nozzle apparatus is electrically connected to the control switch, the nozzle apparatus comprises: an air compressor that enables compressing outside air, a dryer that is connected to the air compressor and filters high-pressure gas carrying moisture content to become dry high-pressure gas, a sand storage tank that is connected to the dryer through a tube and mixes the dry high-pressure gas with internal sand grains, and an outlet tube that is connected to the sand storage tank, a nozzle is used to blow out the dry high-pressure gas mixed with sand grains. The present invention further comprises a dust collecting device disposed within the second casing and coupled to the dust collecting opening of the operating area.

According to one embodiment of the present invention, the dust collecting device comprises a filter screen disposed at the dust collecting opening, a dust bag connected to the dust collecting opening, a high density filter disposed beneath the dust bag, and a dust collector installed beneath a high density filter. Accordingly, the dust collector is able to adsorb and concentrate the dust produced inside the operating area into the dust bag by passing through the dust collecting opening, and then through the filter screen and the high density filter.

According to one embodiment of the creation, the top surface of the operating area has an inclined configuration.

According to one embodiment of the present invention, an enlarging component can be installed on the top surface of the operating area. The enlarging component can be a magnifying glass. Magnetic bodies are fitted to the enlarging component to attach the enlarging component to the first casing. Moreover, the magnetic bodies enable attaching the enlarging component to cover any position on the top surface of the operating area.

According to one embodiment of the present invention, the exterior of the main body is narrow at the front side and wide at the rear side, presenting a slightly diamond shaped body, thus truly conforming to ergonomics design, and enabling convenient operation while sitting down.

According to one embodiment of the present invention, at least one draft hole is formed in the first casing close to one end of the transparent component.

Another objective of the present invention lies in using high-pressure gas mixed with sand grains blown from the nozzle to implement a method of indirect and non-direct contact to remove burrs and surface dirt from extruded objects, and finish the surface of the objects, thereby preventing damage to the surface of the objects.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
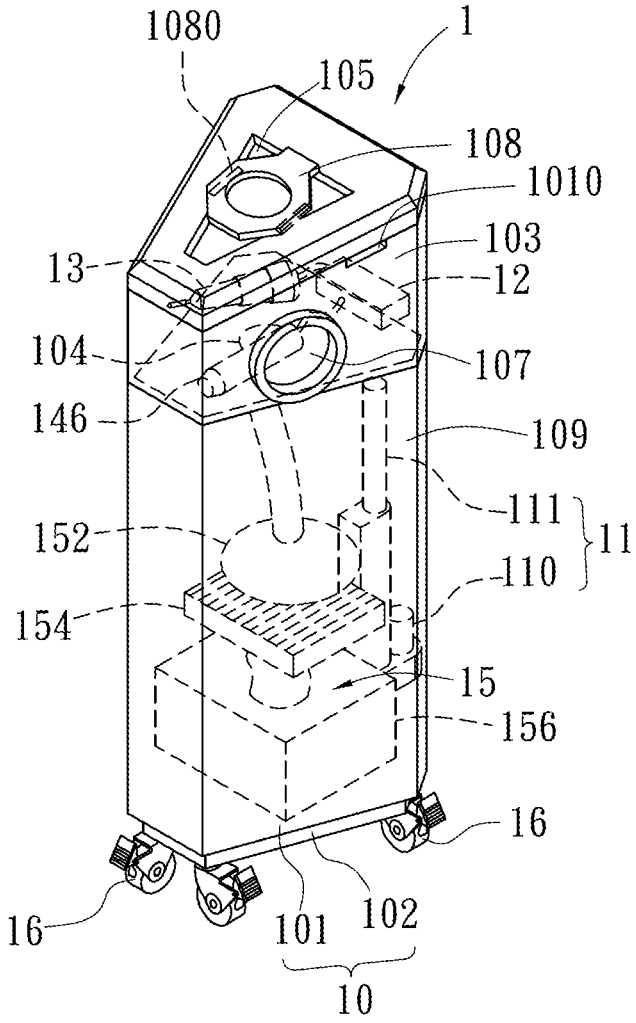
FIG. 1 is a structural schematic view of a three-dimensional perspective of a grinding workbench of the present invention.
Figure 2:
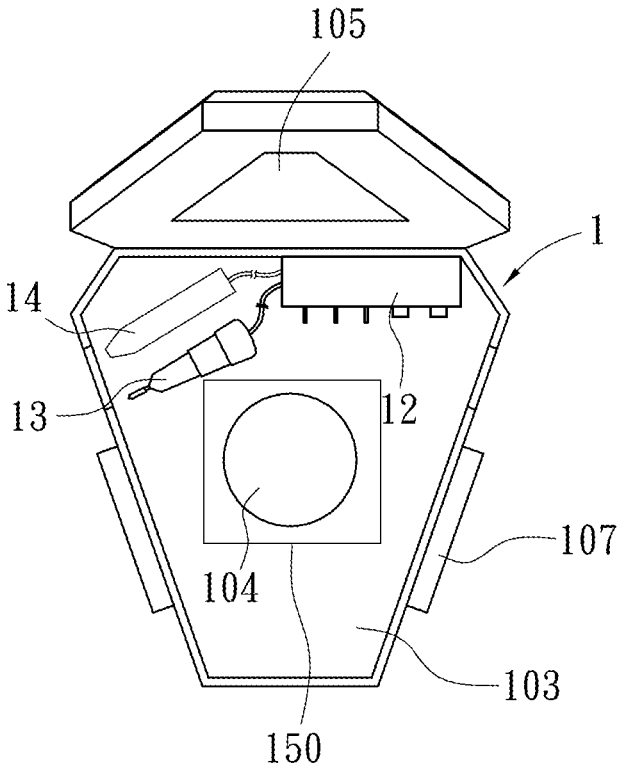
FIG. 2 is a top structural schematic view of the grinding workbench of the present invention.
Figure 3:
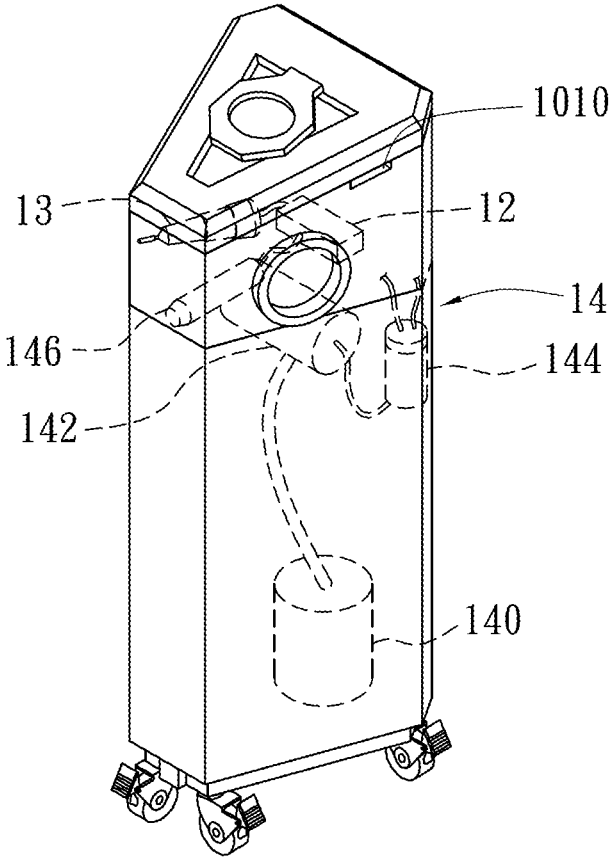
FIG. 3 is a structural schematic view of a nozzle apparatus of the present invention.
Figure 4:
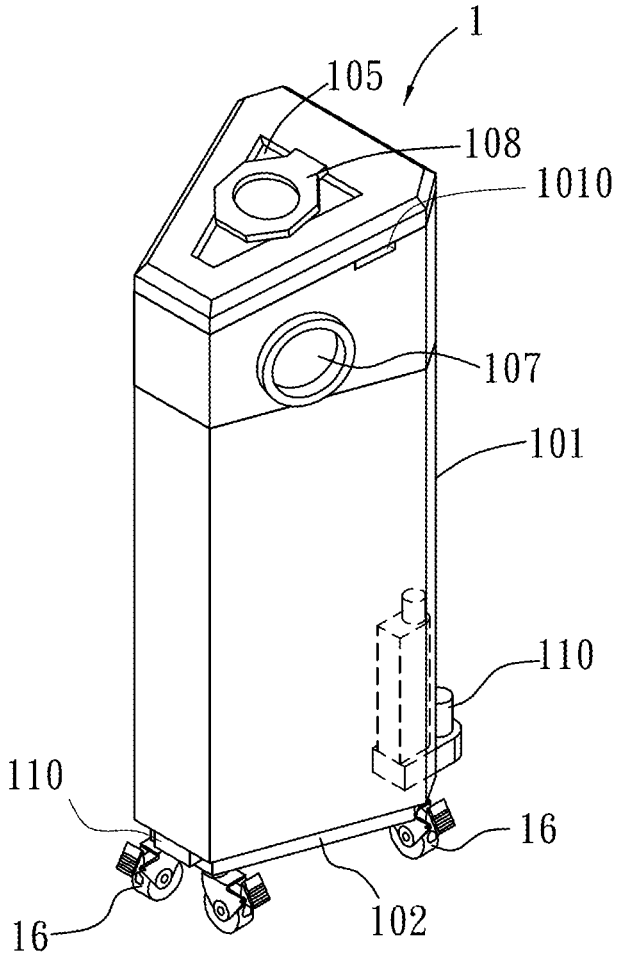
FIG. 4 is a perspective structural schematic view of the grinding workbench of the present invention.
Figure 5:
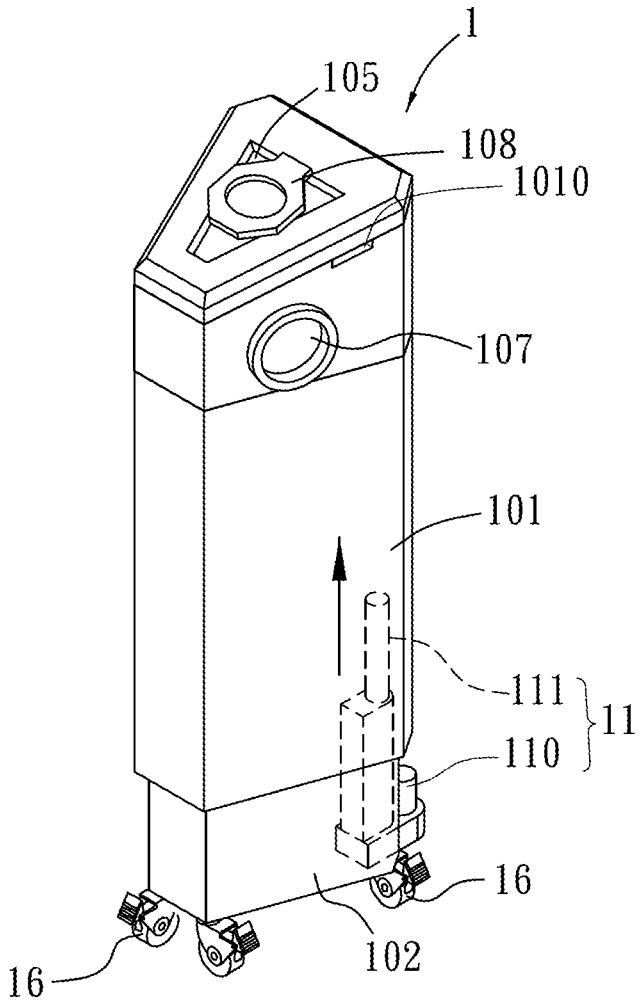
FIG. 5 is a schematic view depicting displacement of a first casing of the grinding workbench of the present invention.
Figure 6:
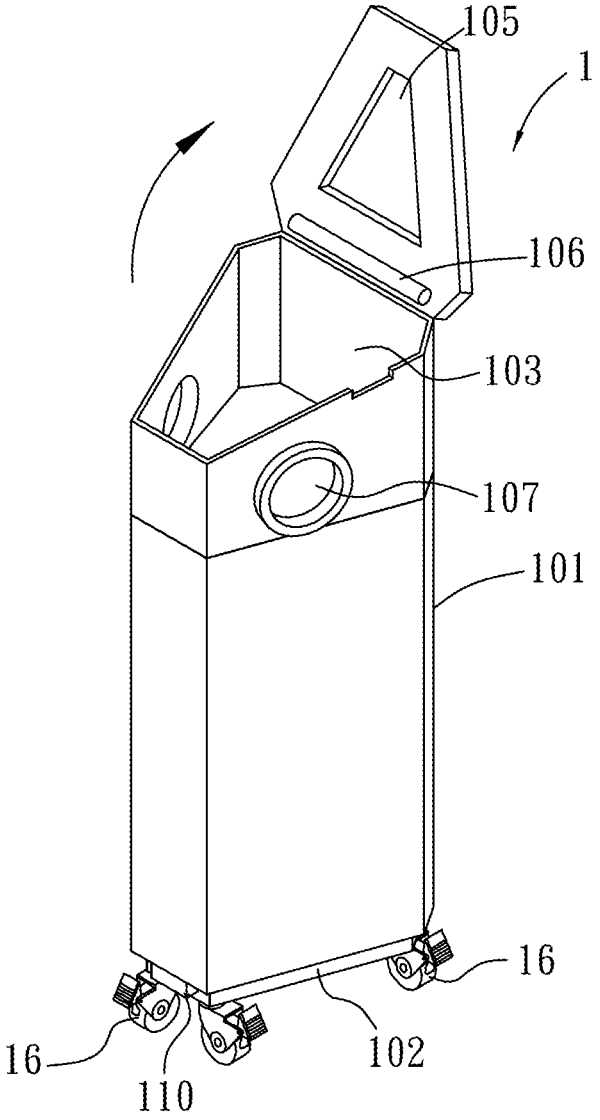
FIG. 6 is a schematic view depicting the risen top surface of an operating area of the grinding workbench of the present invention.

Referring to FIGS. 1 to 6, which respectively show a structural schematic view of a three-dimensional perspective, a top structural schematic view, a structural schematic view of a nozzle apparatus, a perspective structural schematic view, a schematic view depicting displacement of a first casing, and a schematic view depicting the risen top surface of an operating area of a grinding workbench of the present invention. The present invention is a grinding workbench with improved structure, with a grinding workbench 1 being primarily assembled from a main body 10, a lifting device 11, a control switch 12, a grinding device 13, a nozzle apparatus 14, and a dust collecting device 15. In which the main body 10 comprises a first casing 101, and a second casing 102 disposed within the first casing 101. The lifting device 11 is installed inside the second casing 102, and the lifting device 11 is assembled from a lifting platform 110 disposed in the second casing 102, and a lifting rod 111 that is joined to the lifting platform 110 and also connected to the first casing 101, thereby enabling the lifting rod 111 to effect a raising and lowering movement of the first casing 101, and allowing the user to adjust the workbench to a suitable height. The top end of the first casing 101 is configured with an inclined operating area 103 that conforms to ergonomics design. A dust collecting opening 104 is defined in the operating area 103, and a transparent component 105 is disposed on the top surface of the operating area 103. A light emitting component 106 is disposed on the inner side of the top surface of the operating area 103. An operating opening 107 is formed in each of two side walls of the operating area 103, and the operating openings 107 provide passage to the interior of the operating area 103. In addition, the control switch 12 is installed inside the operating area 103, and the grinding device 13 is electrically connected to the control switch 12. A nozzle apparatus 14 is further electrically connected to the control switch 12. The nozzle apparatus 14 comprises: an air compressor 140 that compresses outside air; a dryer 142 that is connected to the air compressor 140 and filters moist high-pressure gas to become dry high-pressure gas; a sand storage tank 144 that mixes the dry high-pressure gas with internal sand grains through a tube connected to the dryer 142; a nozzle 146 provided with an output tube that is connected to the sand storage tank 144 and which is used to blow out the dry high-pressure gas mixed with sand grains; and the dust collecting device 15 that is disposed within the second casing 102 and connected to the dust collecting opening 104 in the operating area 103.

In addition, the dust collecting device 15 of the aforementioned structure further comprises a filter screen 150 installed on the dust collecting opening 104; a dust bag 152 connected to the dust collecting opening 104; a high density filter 154 disposed beneath the dust bag 152; and a dust collector 156 installed beneath the high density filter 154. Accordingly, the dust collector 156 is able to adsorb and concentrate the dust produced inside the operating area 103 into the dust bag 152 by passing through the dust collecting opening 104, and then through the filter screen 150 and the high density filter 154. The top surface of the aforementioned operating area 103 has an inclined configuration to facilitate operation. Moreover, a plurality of mobile wheels 16 can be fitted to the bottom portion of the main body 10, and an enlarging component 108 (such as a magnifying glass) can be installed on the top surface of the operating area 103 to increase the degree of precision and accuracy of the sand blasting process. Magnetic bodies 1080 are installed on the enlarging component 108 to attach the enlarging component 108 to the first casing 101. The magnetic bodies 1080 further enable the enlarging component 108 to cover any position on the top surface of the operating area 103. Furthermore, the exterior of the main body 10 is narrow at the front side and wide at the rear side, presenting a slightly diamond shaped body, allowing for easy operation of the grinding workbench 1 by the user, and causing the two sides of the main body 10 to form an open-ended space 109.

The aforementioned transparent component 105 can be made from plastic or glass to facilitate the user in operating the grinding workbench 1. Furthermore, the top surface of the operating area 103 has an inclined configuration that conforms to ergonomics design, and raising and closing of the top surface corresponds to the configuration of the main body 10. Moreover, the light emitting component 106 is located on the inner side of the top surface, thereby enabling the light-emitting component 106 to further illuminate the operating area 103. The two hands of the user respectively pass through the operating openings 107 on the two sides of the operating area 103 and extend into the interior of the operating area 103 to operate the grinding workbench 1. In addition, the control switch 12 installed inside the operating area 103 enables the user to directly operate the grinding workbench 1 from the interior of the operating area 103. The control switch 12 is further used to control opening and closing of the power supply as well as raising or lowering of the first casing 101.

Raising or lowering of the first casing 101 is effected through the lifting device 11, which is primarily assembled from the lifting platform 110 and the lifting rod 111. The lifting platform 110 is fitted to the second casing 102, and the lifting rod 111 is joined to the lifting platform 110. The lifting rod is also connected to the first casing 101, thereby enabling a raising or lowering movement of the first casing 101 to adjust the height of the grinding workbench 1.

The aforementioned enlarging component 108 can be a magnifying glass, and the magnetic bodies 1080 fitted to a peripheral frame of the enlarging component 108 enable attaching the enlarging component 108 to the top surface of the operating area 103. The enlarging component 108 further enlarges the view of an object to be ground within the operating area 103, thereby enabling the user to better carry out precise and accurate grinding. Furthermore, fitting of the magnetic bodies 1080 enable the enlarging component 108 to be movably located to any position on the top surface of the operating area 103.

The aforementioned grinding device 13 is disposed within the operating area 103 of the main body 10 to facilitate direct use by the user, and is electrically connected to the control switch 12 inside the operating area 103, thereby enabling the control switch 12 to control rotational speed of the grinding device 13. The grinding device 13 can be a conventional grinding machine or a hand grinding machine.

The aforementioned nozzle apparatus 14 comprises: the air compressor 140, the dryer 142, the sand storage tank 144, and the nozzle 146. The air compressor 140 compresses outside air. Moreover, the air compressor 140 also filters high-pressure gas carrying moisture content to become dry high-pressure gas through use of the dryer 142, and further mixes the dry high-pressure gas with sand grains stored inside the sand storage tank 144 through a tube connected to the dryer 142, then the dry high-pressure gas mixed with sand grains is blown out from the nozzle 146 connected to the sand storage tank 144 through an output tube. After which the dust collecting device 15, which is connected to the dust collecting opening 104 of the operating area 103 and disposed within the second casing 102, is used adsorb and filter dust. Because of at least one draft hole 1010 formed in the first casing 101 close to one end of the transparent component 105, thus, at the same time as collecting the dust, air is caused to circulate to maintain convection and achieve dust collecting effectiveness.

The aforementioned dust collecting device 15 is disposed inside the operating area 103 of the second casing 102, and the dust collecting device 15 is further connected to the dust collecting opening 104 of the operating area 103. The dust collecting device 15 comprises the filter screen 150 installed on the dust collecting opening 104, the dust bag 152 connected to the dust collecting opening 104, the high density filter 154 disposed beneath the dust bag 152, and the dust collector 156 installed beneath the high density filter 154. Accordingly, the dust collector 156 is able to adsorb and concentrate the dust produced inside the operating area 103 into the dust bag 152 by passing through the dust collecting opening 104, and then through the filter screen 150 and the high density filter 154.

Each of the aforementioned mobile wheels 16 is fitted to the bottom portion of the main body 10, and are used to enable movement of the main body 1. When a user is operating the grinding workbench 1, the user's two feet can be respectively placed on the two sides of the open-ended space 109 of the main body 10, thereby enabling the user to correctly face the top surface of the operating area 103 of the main body 10. Whereupon, the user can extend their two hands through the operating openings 107 on the two sides of the operating area 103 into the interior of the operating area 103. Moreover, the user is able to start up the grinding workbench 1 and control the height of the first casing 101 through use of the control switch 12 inside the operating area 103. The user is able to use the control switch 12 to adjust the grinding workbench 1 to a suitable height by raising or lowering the first casing 101.

After which, the user is able to raise the top surface of the operating area 103, place the object to be ground within the operating area 103, and view the position of the object to be ground through the transparent component 105 of the operating area 103. Moreover, the enlarging component 108 enables enlarging the object to be ground to better carry out precise and accurate grinding, and further prevents injury to the user because of misoperation during the grinding process. When operating the grinding workbench 1, the user can first turn on the grinding device 13 and the dust collecting device 15, then proceed with grinding the object to be ground by using the grinding device 13. The dust produced during the grinding process enters the dust collecting opening 104 at the bottom portion of the operating area 103, and first filtering of the dust is carried out using the filter screen 150 located on the dust collecting opening 104. The dust that passes through the filter screen 150 enters the dust bag 152 and is concentrated therein. The dust that passes through the dust bag 152 then enters the high density filter 154, which is used to improve concentration of the dust and filter effectiveness. After which, using a method of indirect and non-direct contact to prevent damage to the surface of the object and injury to the user, the nozzle apparatus 14 uses the high-pressure gas mixed with sand grains blown out from the nozzle 146 to remove burrs from an extruded object as well as surface dirt, and finish the surface of the object.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A grinding workbench with improved structure, comprising:

a main body, the main body comprises a first casing, and a second casing disposed within the first casing, the second casing is equipped with a lifting device, and the lifting device is assembled from a lifting platform disposed in the second casing; and a lifting rod that is joined to the lifting platform and also connected to the first casing, thereby enabling a raising and lowering movement of the first casing;

an operating area configured at a top end of the first casing, a dust collecting opening is defined within the operating area, a transparent component is disposed on a top surface of the operating area, and a light emitting component is disposed on an inner side of the top surface of the operating area, an operating opening is formed in each of two side walls of the operating area, and the operating openings provide passage to an interior of the operating area; the interior of the operating area is fitted with a control switch, a grinding device is electrically connected to the control switch, and a nozzle apparatus is electrically connected to the control switch; the nozzle apparatus comprises an air compressor that compresses outside air, a dryer that is connected to the air compressor and which filters moist high-pressure gas to become dry high-pressure gas, a sand storage tank that is connected to the dryer through a tube and which mixes the dry high-pressure gas with internal sand grains, and an outlet tube that is connected to the sand storage tank; a nozzle is used to blow out the dry high-pressure gas mixed with sand grains;

and a dust collecting device, the dust collecting device is disposed within the second casing and connected to the dust collecting opening of the operating area.

2. The grinding workbench with improved structure according to claim 1, wherein the dust collecting device comprises a filter screen installed on the dust collecting opening, a dust bag connected to the dust collecting opening, a high density filter disposed beneath the dust bag, and a dust collector installed beneath the high density filter; whereby the dust produced inside the operating area is adsorbed and concentrated by being passed through the filter screen installed on the dust collecting opening, into the dust bag, through the high density filter, and into the dust collector.

3. The grinding workbench with improved structure according to claim 1, wherein the top surface of the operating area has an inclined configuration.

4. The grinding workbench with improved structure according to claim 1, wherein a plurality of mobile wheels are fitted to a bottom portion of the main body.

5. The grinding workbench with improved structure according to claim 1, wherein an enlarging component is installed on the top surface of the operating area.

6. The grinding workbench with improved structure according to claim 5, wherein the enlarging component is a magnifying glass.

7. The grinding workbench with improved structure according to claim 5, wherein magnetic bodies are disposed on the enlarging component; the magnetic bodies are used to attach the enlarging component to the first casing and enable the enlarging component to cover any position on the top surface of the operating area.

8. The grinding workbench with improved structure according to claim 1, wherein an exterior of the main body is narrow at a front side and wide at a rear side, presenting a slightly diamond shaped body and causing two sides of the main body to form an open-ended space.

* * * * *